United States Patent [19]

Schnell

[11] Patent Number: 4,834,396

[45] Date of Patent: May 30, 1989

[54] MULTI-EXERCISING APPARATUS

[76] Inventor: Josef Schnell, Sportweg 9, Ortsteil Peutenhausen, 8899 Gachenbach, Fed. Rep. of Germany

[21] Appl. No.: 67,620

[22] Filed: Jun. 25, 1987

[30] Foreign Application Priority Data

Jul. 9, 1986 [DE] Fed. Rep. of Germany ..... 3623144
Dec. 30, 1986 [DE] Fed. Rep. of Germany ..... 3644764

[51] Int. Cl.[4] ..... A63B 21/00

[52] U.S. Cl. ..... 272/117; 272/134; 272/144

[58] Field of Search ..... 272/117, 118, 123, 134, 272/136, 144, 145, DIG. 4, DIG. 5

[56] References Cited

U.S. PATENT DOCUMENTS

| | | | |
|---|---|---|---|
| 3,000,632 | 9/1961 | Fuchs | 272/117 |
| 3,171,652 | 3/1965 | Newman | 272/123 |
| 3,856,297 | 12/1974 | Schnell | 272/117 X |
| 4,076,236 | 2/1978 | Ionel | 272/123 |
| 4,492,375 | 1/1985 | Connelly | 272/117 X |
| 4,502,681 | 3/1985 | Blomquist | 272/DIG. 5 X |
| 4,564,194 | 1/1986 | Dawson | 272/144 X |
| 4,586,510 | 5/1986 | Glaser et al. | 272/117 X |
| 4,666,151 | 5/1987 | Chillier | 272/136 X |

FOREIGN PATENT DOCUMENTS

| | | | |
|---|---|---|---|
| 3140859 | 4/1983 | Fed. Rep. of Germany | 272/117 |
| 3423837 | 1/1986 | Fed. Rep. of Germany | 272/134 |

*Primary Examiner*—Richard J. Apley
*Assistant Examiner*—Robert W. Bahr
*Attorney, Agent, or Firm*—Henry M. Feiereisen

[57] ABSTRACT

A multi-exercising apparatus includes a housing frame with a crank arm at one side and a weight arm at the other side thereof. The housing frame includes a plurality of openings at the one side to allow a training bench to be selectively attached. At its other side, the housing frame includes further openings in which a stop member is selectively inserted to position the weight arm in a desired manner. By attaching the training bench in a desired opening and adjusting the weight arm by the stop member, a user is able to perform a wide variety of exercises and to adjust the resistance as exerted by the weight arm during actuation of the crank arm.

20 Claims, 7 Drawing Sheets

MULTI-EXERCISING APPARATUS

BACKGROUND OF THE INVENTION

The present invention refers to a multi-exercising apparatus which allows the exercise of a wide variety of muscle sections.

Exercising machines are known which include a frame, a support for the user which is attached to the frame and a training arm which is directly or indirectly connected to a weight arm carrying one or several weight units. The connection of the training arm and the weight arm is disengageable in order to allow a modification of the angular position therebetween.

Such exercising machines have been widely used in practice although they allow the exercise of only a very limited section of muscles. Thus, installation of exercising circuits have been proposed which include a variety of individual exercising machines to give the user the possibility of exercising different muscle sections. Apart from the fact that the installation of numerous exercising machines is rather expensive, the demand on space is also excessive.

SUMMARY OF THE INVENTION

It is a principal object of the present invention to provide a multi-exercising apparatus obviating the afore-stated drawbacks.

This object and others which will become apparent hereinafter is attained in accordance with the present invention by providing a support for a user which is selectively connectable to a housing frame supporting at its one side a training arm and at its other side a weight arm which provides resistance during actuation of the training arm wherein the weight arm is releasably connected to said training arm for angular adjustment therebetween and is selectively positionable at the other side of said housing frame for adjustment of the resistance.

Through the provision of an exercising apparatus in accordance with the present invention, a wide variety of different exercises may be performed without requiring a multitude of different exercising machines which is expensive and demands considerable space. Thus, a single apparatus can now be used for exercising all muscle sections. Apart from an economical and a space-saving standpoint, the multi-exercising apparatus according to the invention has also the advantage of superior convenience as it avoids the necessity of running between various machines to perform respective exercises, and is easily be modified and prepared for allowing the exercise of the legs, arms, abdominal muscles and back muscles etc.

According to a further feature of the present invention, the housing frame includes a plurality of openings in which the support is selectively connected via a mounting arm in dependence on the chosen exercise. This simple connection provides long durability and functional safety without complicating its handling. Securing the support after being inserted into the selected opening may be obtained in various manner, e.g. providing the mounting arm with essentially corresponding cross section as the opening or by using screws or the like to tighten the mounting arm.

In order to adjust the resistance by the weight arm, the housing frame is provided with further openings at the other side opposite to the support or crank arm. A stop member is selectively insertable via a mounting arm in these openings so that the position of the weight arm at the start of the exercise may be selected. The adjustment of the stop member and thus of the weight arm is attained in a simple and quick manner without danger. The stop member is preferably of elastic material to compensate hard impacts which otherwise would result in wear, and to reduce disturbing noise.

The support may be a training bench which is extendable through respective extensions to allow the user not only to sit but also lying on the back or with face down. In addition, a seat bench may also be connectable to the base of the housing frame so that the user may carry out such exercises as "bench press".

According to yet another feature of the invention, the user is instructed about the correct attachment of the support, weight arm and crank arm by an indicator disk which is attached to the front of the exercising apparatus in his or her field of view. The indicator disk has a number of colored arrows indicating the corresponding exercises with colored characters. The openings at each side of the housing frame are also marked with colors. Thus, when selecting a particular exercise, the user attaches the support in the openings which is marked with the same color as the color of the arrow on the indicator disk while the stop member is inserted in the opening whose color corresponds to the color of the character by which the name of the exercise is written on the arrow. The crank arm is positioned essentially in alignment with the arrow.

BRIEF DESCRIPTION OF THE DRAWING

The above and other objects, features and advantages of the present invention will now be described in more detail with reference to the accompanying drawing in which.

DESCRIPTION OF PREFERRED EMBODIMENTS

Figure 1:
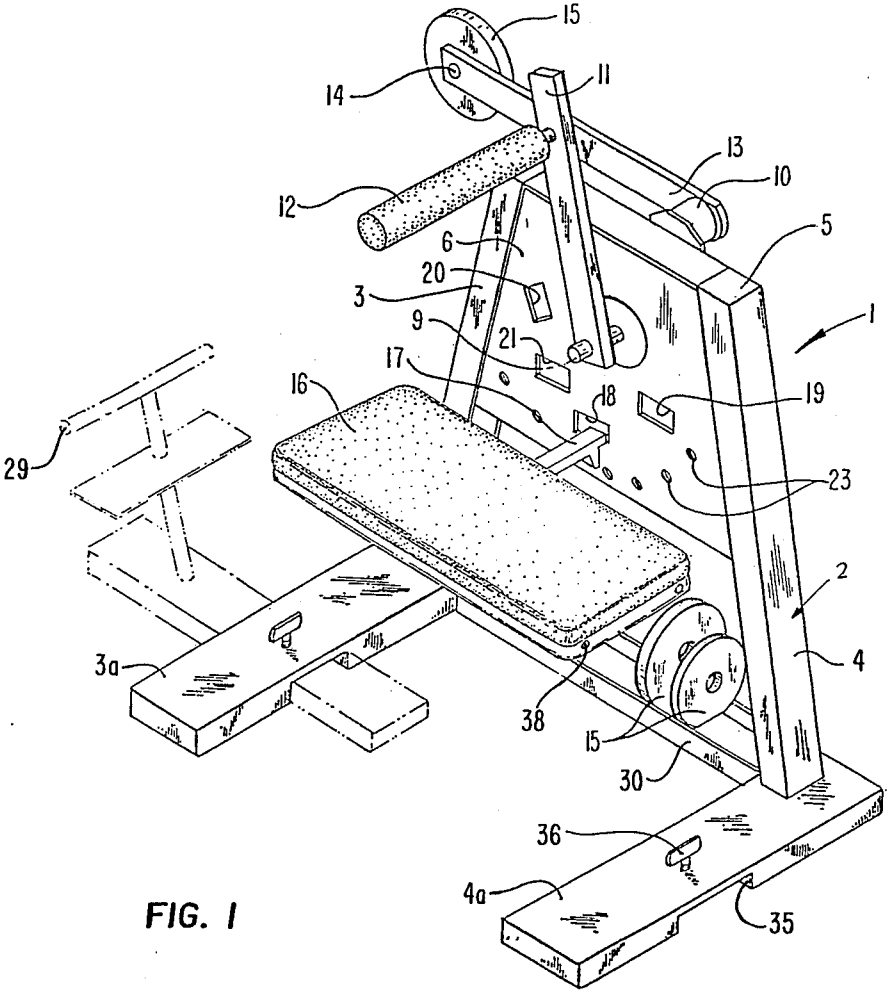
FIG. 1 is a perspective view of one embodiment of a multi-exercising apparatus according to the invention.

In the drawing, there is shown one embodiment of a multi-exercising apparatus generally designated by reference numeral 1 and provided to allow a user to perform a wide variety of exercises for all muscle sections. The exercising apparatus 1 has a trestle-like housing frame with a stand 2 having slanting uprights 3, 4 which are supported by elongated base members 3*a*, 4*a* resting on the floor. The stand 2 supports a box-like housing member 5 of trapezoid shape which allows a support member 16 in form of a training bench or training table to be selectively attached as will be described furtherbelow.

The housing member 5 includes two side walls 6, 7 between which a gear box 8 is placed. For matter of convenience of illustration, the gear box 8 is not shown in detail. Suitably, the gear box 8 includes one pair of gears rotatably mounted on pertaining shafts 9, 10. In the nonlimiting example, the gears are dimensioned in such a manner that a transmission ratio of about 1:2 is produced between the shaft 9 and shaft 10. Thus, upon selection of such a gear reduction, an angular movement of shaft 9 by 180° provides an angular movement of the shaft 10 of about 90°. For purposes which will be apparent hereinafter, the gears can be brought out of mesh by axially shifting one of the shafts 9, 10. It will be appreciated that a direct releasable connection between the shaft 9 and the shaft 10 may also be feasible.

The shaft 9 projects with one end thereof through the side wall 6 to support a crank arm or training arm 11 which is actuated by the user to perform various exercises. Rotatably mounted on the end of the crank arm 11 is a roller 12, preferably a padded roller, which extends horizontally outwardly from the housing member 5 so as to be engagable by the user. Opposite to the crank arm 11 at the other side of the housing member 5, the shaft 10 projects through the side wall 7 to support a weight arm or lever arm 13 which provides the necessary resistance or counterweight during exercise.

The weight arm 13 is provided at its free end remote to the shaft 10 with a shaft stub 14 which supports a selective number of weights 15. Although the drawing illustrates weights 15 of disk-like shape, the use of any other suitable shape of weights is certainly feasible. The weights 15 are placed on the shaft stub 14 and are fastened by any suitable means like pins, caps or the like. Unused weights 15 are stored in a plurality of slots 31 which are provided in a crossbar 30 connecting the base members 3*a*, 4*a* at a distance to the floor as is shown in particular in FIGS. 1 and 2.

As already described, one of the shafts 9, 10, in the present nonlimiting example the shaft 9, is axially shiftable to disengage the gears of the gear box 8 so that the angular position of the crank arm 11 can be adjusted relative to the weight arm 13. The gears are brought into mesh by simply reversing the axial movement of the shaft 9. Adjustability of the crank arm 11 is necessary to allow the user to perform the various exercises as will now be described.

Figure 5:
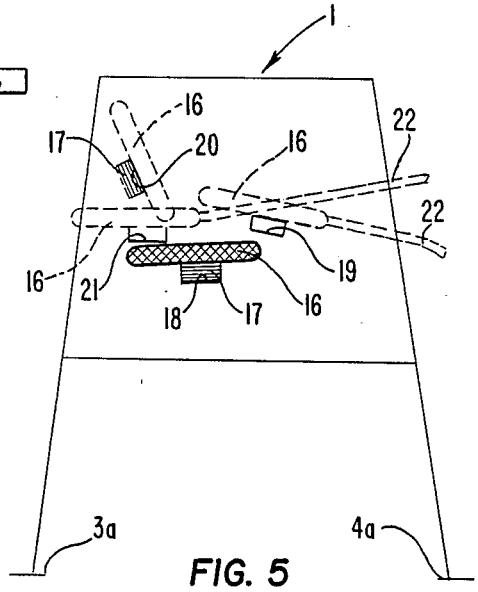
FIG. 5 is a front view in a schematic illustration of the exercising apparatus depicting the training bench in various positions.

The side wall 6 of the housing member 5 is provided with a plurality of openings 18, 19, 20, 21 which are disposed and spaced from each other in such a manner that the support member 16 can be brought into various positions. As illustrated in FIG. 5, the support member 16 is e.g. connected to opening 18 while its other possible positions are indicated by broken line. For purpose of clarity, the support member 16 inserted in opening 20 is shown in shortened illustration. FIGS. 9–18 depict various exercises with the support member 16 selectively attached in the openings 18–21 as will be described furtherbelow.

It will be appreciated that the openings 18–21 may certainly be provided also in mirror-inverted arrangement without changing the basic structure of the present invention.

The support member 16 is mounted on a lateral mounting arm 17 which is selectively inserted in one of the openings 18–21. Although not shown in detail, the versatility of the exercising apparatus 1 can be enhanced by suitably connecting the mounting arm 17 to the support member 16 in a fixed but still rotatable manner so that the support member 16 may be tilted and thus be adjusted for the convenience of the user. The end of the mounting arm 17 remote to the support member 16 is engaged by suitable locking means within the housing member 5 to prevent a slipping out thereof. Alternatively, the openings 18–21 may also be designed as rectangular tubes extending transversely through the housing member 5 so as to define a guideway or chute for the mounting arm 17 which is essentially of the same cross section as the openings 18–21 and thus kept in secure and accurate position. The guideway may be closed at one side or may extend through the width of the housing member 5 so that the mounting arm 17 may be secured at its other end at the opposing wall 7 by a screw or the like as indicated in FIG. 3 at 18*a*, 19*a*, 20*a*, 21*a*.

Figure 8:
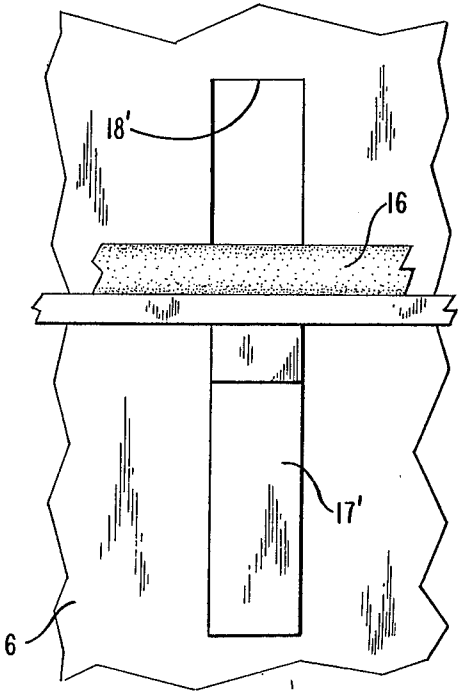
FIG. 8 is a partial front view in schematic illustration of the exercising apparatus according to FIG. 7.
Figure 7:
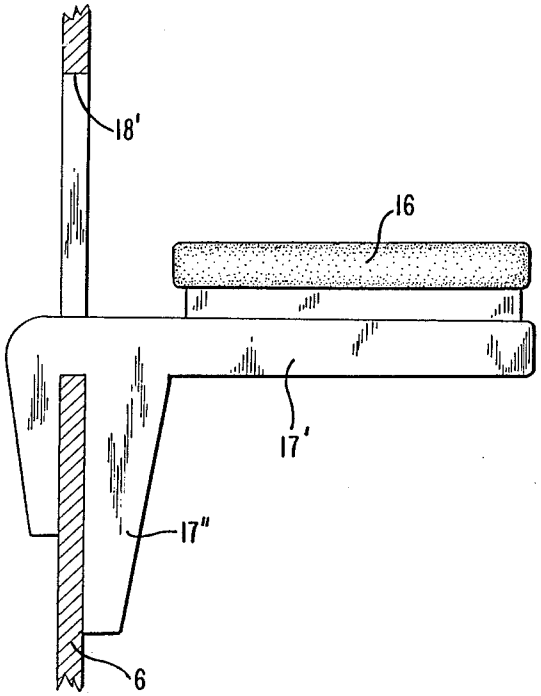
FIG. 7 is a partial cross sectional view of the exercising apparatus with modified attachment for the training bench.

A further alternative of attachment for the support member 16 is shown in FIGS. 7 and 8. In this embodiment, the openings 18–21 (only one opening is shown, namely opening 18') are of slot-like shape, and the mounting arm 17' is provided with a fork-like bracket 17'' which embraces the lower edge of the slot 18' to securely attach the support member 16 to the side wall 6.

Figure 2:
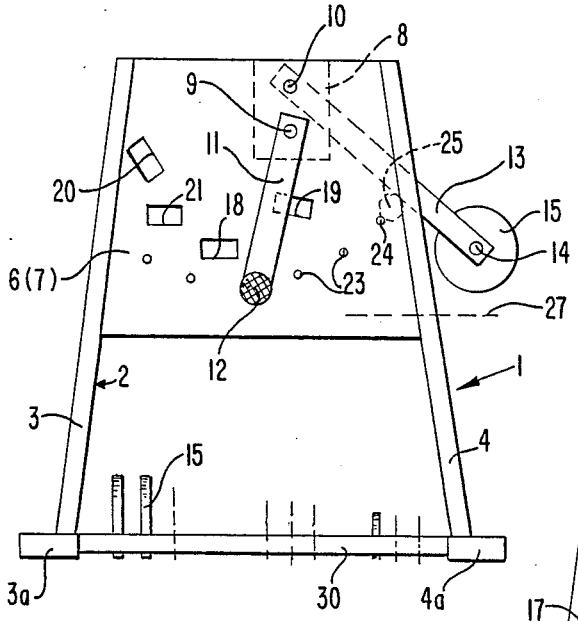
FIG. 2 is a front view thereof depicting the exercising apparatus without a training bench.
Figure 3:
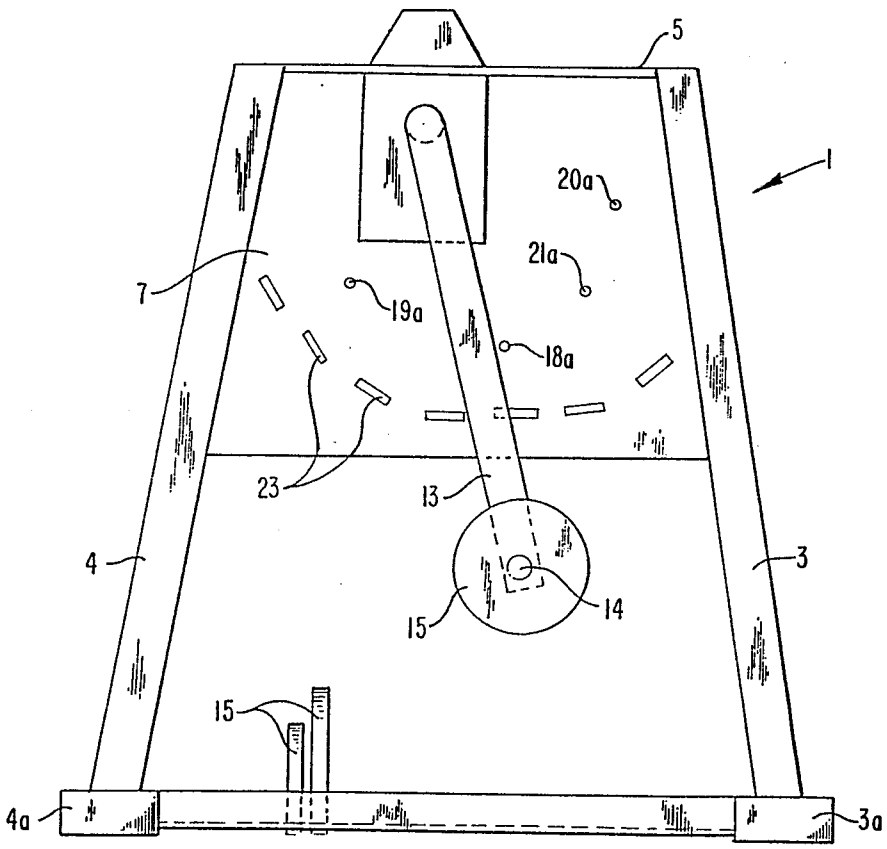
FIG. 3 is a rear view of the exercising apparatus.
Figure 6:
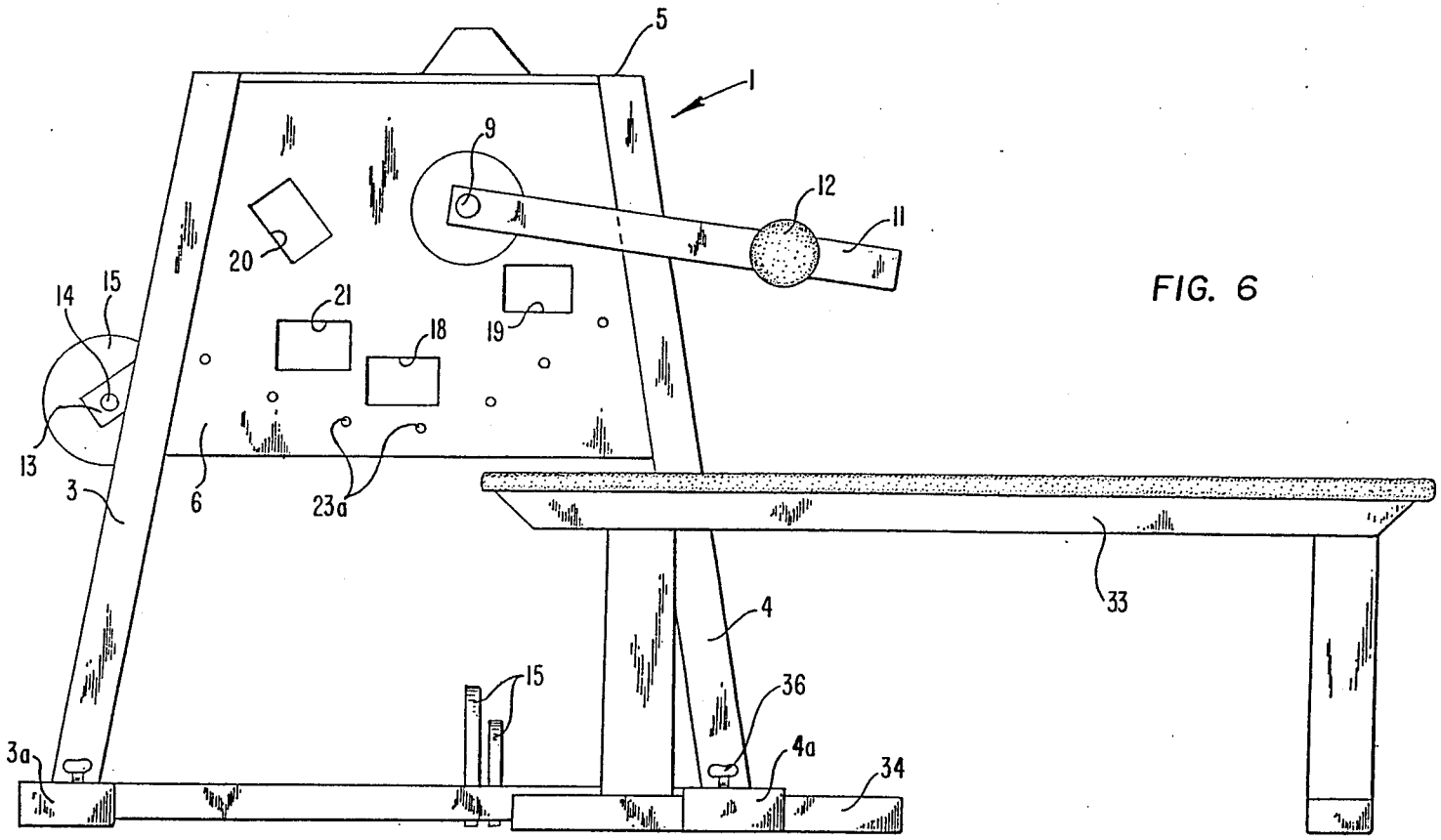
FIG. 6 is a front view of the exercising apparatus provided with a bench.

Referring now to FIG. 3 which is a rear view of the exercising apparatus 1, there is shown that the side wall 7 is provided with a plurality of openings 23 of e.g. rectangular shape. The openings 23 may be defined by hollow sections or rectangular tubes similar to the openings 18–21 and may extend through the width of the housing member 5 as illustrated in FIG. 2. The openings 23 are spaced from each other about a circular arc concentric to the shaft 10. Selectively insertable in the openings 23 is a mounting arm 24 of a stop member 25 which locks the movement of the weight arm 13 in one direction and preferably may be an elastic block of e.g. rubber. It will be appreciated that the mounting arm 24 of the stop members 25 may be suitably designed as the mounting arm 16 so as to be fastenable by screws, nuts or the like as indicated in FIG. 6 at 23*a*.

It will be readily recognized that the resistance exerted by the weights 15 against the user upon actuating the crank arm 17 is thus not only adjustable by the selection of weights 15 but also by suitably inserting the stop member 25 via its mounting arm 24 in a respective one of the openings 23. In the drawing, the weight arm 13 points to the right and rests on the stop member 25 which has been inserted in the respective opening 23. When adjusting the weight arm 13 to point to the left, the mounting arm 24 is rotated with its stop member 25 by 180° and inserted in the respective one of the openings 23.

Figure 4:
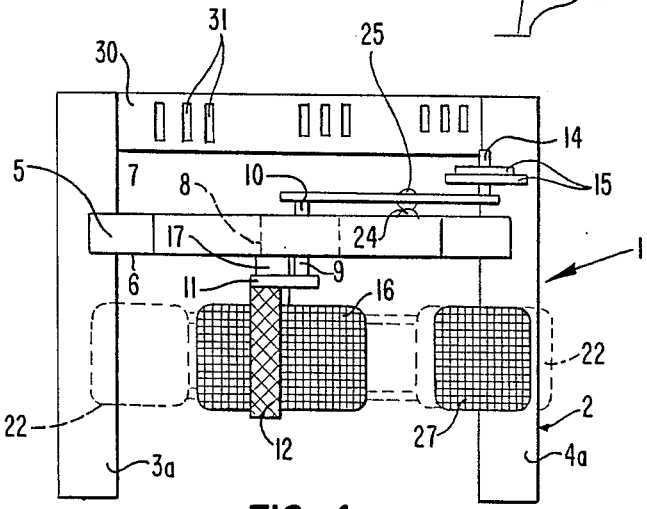
FIG. 4 is a top view thereof depicting the training bench with extensions.

Turning now in particular to FIG. 4 which is a top view of the exercising apparatus 1, there is shown that the support member 16 is adapted to selectively receive an extension bench 22 at opposing sides thereof. Each extension 22 is insertable into respective openings 38 in the frame of the support member 16 and may be pushed or pulled in an inclined position relative to the support member 16 depending on the selected exercise. The openings 38 are only schematically indicated in FIG. 1.

Preferably the extension 22 is padded for the comfort of the user.

Figure 9:
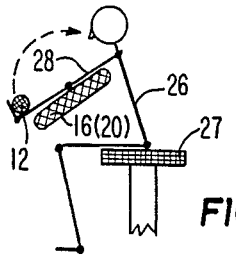
Figure 10:
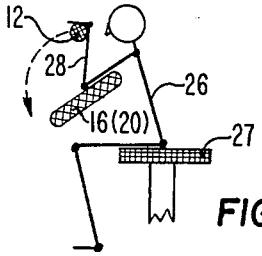

In addition to the support member 16, the exercising apparatus 1 may be equipped with a seat 27 (FIG. 4) which is suitably attached to the base members 3a, 4a to allow the user to sit thereon and to use member 16 for support of e.g. the elbows as shown in FIGS. 9 and 10. For performing e.g the exercise "bench press" (FIG. 18), the required support is provided in form of a bench 33 (FIG. 6) which allows the user to lie flat on his back and to actuate the crank arm 11. The bench 33 includes an elongated mounting element 34 which traverses a throughhole 35 in the base member 4a and is fastened thereto via a suitable screw 36.

The user is instructed about a correct positioning of the crank arm 11, of the stop member 25 and of the support member 16 by an indicator disk 37 which is attached to the side wall 6 within the field of view of the user. The indicator disk 37 is concentrically arranged to the shaft 9 and includes a plurality of colored arrows indicating the direction in which the crank arm 11 is to be moved. Each arrow has the name of the exercise written thereon by colored characters. The colors of the arrows instruct the user in which opening 18–21 the support member 16 is to be inserted. Of course, the openings 18–23 are marked by respective colors as well. In addition, the characters indicating the name of the exercise inform the user by their color into which of the openings 23—which are respectively marked by colors—the stop member 25 should be inserted for the selected exercise. Further, the arrows indicate the direction by which the crank arm 11 is to be moved during exercise in order to lift the weight arm 13.

Referring now to FIGS. 9–18, there are shown various exercises which can be performed with the exercising apparatus 1 according to the invention. For exercising the biceps as shown in FIG. 9, the user 26 inserts the support member 16 into the opening 20 which is marked by the same color as the arrow termed "BICEPS" and is rotated by about 90° relative to the mounting arm 17 so that the support member 16 is in a proper position for this exercise. Of course, when providing the opening 18–21 in mirror-inverted arrangement, the support member 16 would already be positioned correctly so that a rigid connection between support member 16 and mounting arm 17 is possible.

After having attached the support member 16, the user 26 inserts the stop member 25 in one of the openings 23 whose color corresponds to the color by which the characters of the term "BICEPS" are depicted. The characters do not have to be of one color; rather they ma be of varying color to select the degree of resistance as exerted by the weight arm 13. The crank arm 11 is then disengaged from the weight arm 13 through axial displacement and positioned in approximate alignment with the arrow indicating the exercise.

Once the exercising apparatus 1 is adjusted in this manner, the user 26 rests the upper portion of its arms 28 on the support member 16 while sitting on the seat 27 and moves with the hands the roller 12 in direction of the arrow indicated in broken line. The weight arm 13 with the weights 15 is lifted by the actuation of the crank arm 11 and resists the movement of the same so as to exercise the biceps.

FIG. 10 shows the exercise of the triceps. As the roller 12 is to be moved downwards as indicated by the arrow, the weight arm 13 has to exert a counterforce in opposite direction. The adjustment of the exercising apparatus is done in a corresponding manner as described in connection with FIG. 9.

Figure 11:
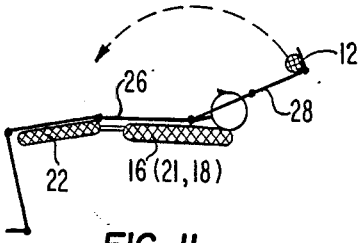
Figure 12:
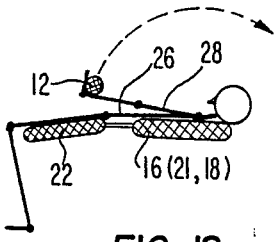

The exercises as depicted in FIGS. 11 and 12 are "pullover" and "arm raise" for training the shoulder muscles. In this case, the support member 16 is inserted in opening 21. It may, however, also be possible to attach the support member in opening 18. For supporting the legs, an extension 22 is connected to the support member 16 at slight downward inclination. The crank arm 11 is again positioned in alignment with the arrows indicating the respective exercise.

Figure 13:
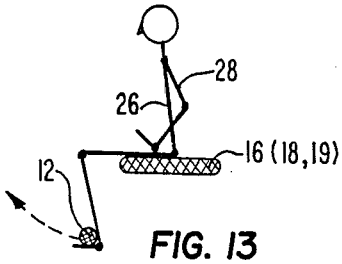

FIG. 13 illustrates the exercise "leg extension" with the user 26 sitting on the support member 16 which is inserted into the opening 18 or 19 depending on the height of the user 26.

Figure 14:
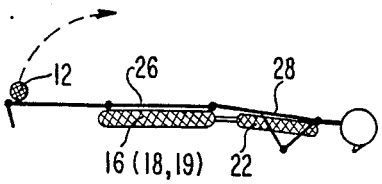

For performing the exercise "thigh curl" as shown in FIG. 14, a slightly downwardly inclined extension bench 22 is attached to the support member 16, and the user 26 lies on the benches 16 and 22 with its face down and with its lower leg parts engaging the roller 12 to move the crank arm 11. The support member 16 is inserted in either opening 18 or 19.

Figure 15:
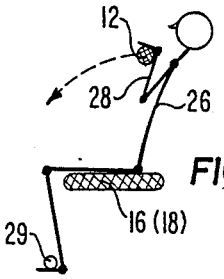
Figure 16:
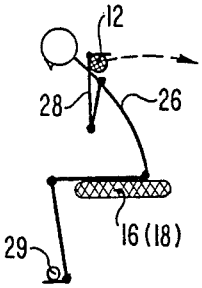

The abdominal muscles and back muscles are exercised in accordance with FIGS. 15 and 16. The support member 16 is inserted in opening 18. Crank arm 11 and stop member 25 are set according to the indicator disk 37. In addition, as shown in FIG. 1, a stationary foot support 29 is attached to the base member 3a in the same manner as the seat 27' in order to provide the required resistance during this exercise. The foot support 29 is illustrated in broken line in FIG. 1 and may be padded for the comfort of the user 26.

Figure 17:
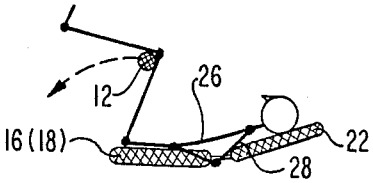
Figure 19:
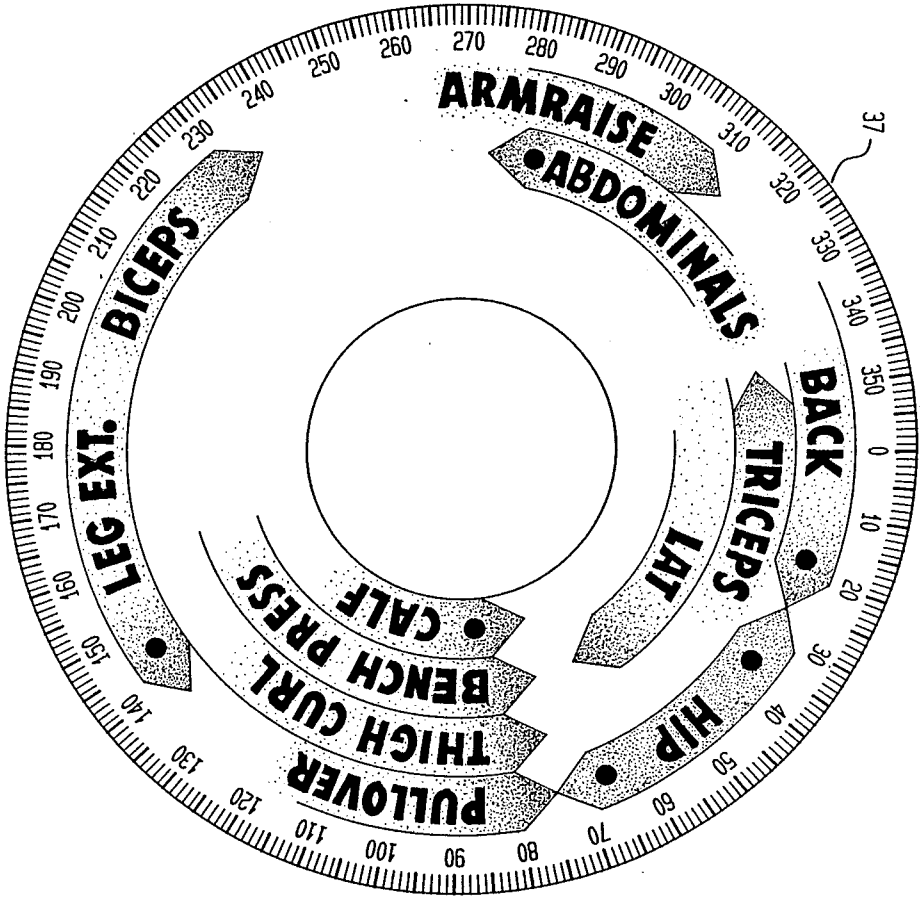
FIG. 19 is an illustration of an indicator attached to the exercising apparatus to instruct a user about the various exercises.

FIG. 17 illustrates the exercise of hip muscles. For support of the head, the extension 22 is suitably attached to the support member 16 which is inserted in opening 18. The roller 12 is engaged in the hollow of the knee.

Figure 18:
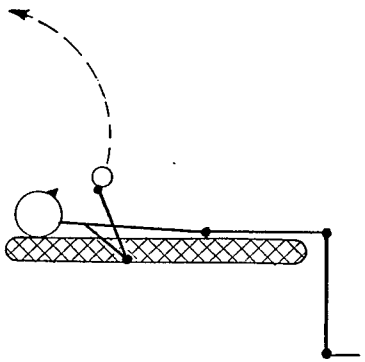
FIGS. 9–18 are simplified schematic illustrations of various exercises to be able to carry out with the exercising apparatus.

In FIG. 18, the exercise "bench press" is illustrated. Accordingly, the user 26 lies on the bench 33 which is attached to the exercising apparatus 1 in a manner as described with reference to FIG. 6. Adjustment of the crank arm 11 and the stop member 25 and thus of the weight arm 13 is again carried out in accordance with the instruction as provided by the indicator disk 37.

While the invention has been illustrated and described as embodied in a Multi-Exercising Apparatus, it is not intended to be limited to the details shown since various modifications and structural changes may be made without departing in any way from the spirit of my present invention.

What is claimed as new and desired to be protected by Letters Patent is set forth in the appended claims:

1. Multi-exercising apparatus, comprising:

a housing frame including a side wall having a plurality of spaced openings arranged in an arcuate path;

a variable support provided for a user and having mounting means selectively insertable in said openings of said housing frame at one side thereof, said arrangement of openings being such that said entire support is positionable in a variety of angular orientations for exercising a wide variety of different muscle sections;

a user-actuated member releaseably attached at said one side of said housing frame so as to be positionable in dependence upon the position of said support;

a weight member providing resistance during exercise and being releasably connected to said user-actuated member on the other side of said housing frame to allow an angular adjustment between said user-actuated member and said weight member; and adjusting means for selectively positioning said weight member at the other side of said housing frame and for modifying the load exerted by said weight member by respectively positioning the latter.

2. Multi-exercising apparatus as defined in claim 1 wherein said mounting means includes a lateral mounting arm which is selectively insertable in said openings for attaching said support to said housing frame.

3. Multi-exercising apparatus as defined in claim 2 wherein said mounting arm is rotatably connected to said support for angular adjustment thereof.

4. Multi-exercising apparatus as defined in claim 1 wherein each of said openings has a cross section essentially corresponding to the cross section of said mounting arm.

5. Multi-exercising apparatus as defined in claim 1, and further comprising an extension element connectable to said support for extending the latter in longitudinal direction thereof.

6. Multi-exercising apparatus as defined in claim 5 wherein said support and said extension member are each padded with a suitable material.

7. Multi-exercising apparatus as defined in claim 5 wherein said extension member is releasably connected to said support at a slight inclination.

8. Multi-exercising apparatus as defined in claim 1 wherein said other side of said housing frame includes a plurality of openings, said adjusting means including a stop member provided with a mounting arm which is selectively insertable into said openings for positioning and cooperation with said weight arm.

9. Multi-exercising apparatus as defined in claim 8 wherein said stop member is made of elastic material.

10. Multi-exercising apparatus as defined in claim 8 wherein said weight member is a weight arm mounted to said housing frame via a shaft, said openings being arranged about a circular arc concentric to said shaft of said weight arm.

11. Multi-exercising apparatus as defined in claim 1 wherein said user-actuated member is a crank arm mounted to said housing frame via a shaft and provided with a roller at its end remote to said shaft for allowing a user to actuate said crank arm.

12. Multi-exercising apparatus as defined in claim 1, wherein said housing frame has a pair of uprights each of which including a base provided with a throughhole, and further comprising a seat connectable to said base of said housing frame.

13. Multi-exercising apparatus as defined in claim 1, and further comprising weight units releasably connected to said weight member.

14. Multi-exercising apparatus as defined in claim 13 wherein said housing frame has a pair of uprights connected to each other via a crossbar, said crossbar including a plurality of slots for receiving unused weights for their storage.

15. Multi-exercising apparatus as defined in claim 1, and further comprising indicating means for instructing the user about positioning of said support, said adjusting means and said user-actuated member in accordance with a selected exercise, said indicating means being an indicator disk attached to said one side of said housing frame.

16. Multi-exercising apparatus as defined in claim 15 wherein said housing frame is provided with a colored marking at each connection between said housing frame, on the one hand, and said support and said adjusting means, on the other hand, said indicator disk including a plurality of colored arrows representing specific exercises, the name of which being written along the pertaining one of said arrows with colored characters, said support being connected to said housing frame at the marking which corresponds to the color of the pertaining one of said arrows, and said adjusting means being attached to said housing frame at the marking which corresponds to the color of the characters on said arrow while said user-actuated member being positioned essentially in alignment with said arrow and actuated in direction thereof.

17. Multi-exercising apparatus as defined in claim 1 wherein said housing frame includes a plurality of slots at said one side, said support including a mounting arm provided with a forked end so as to be selectively connectable in said slots for attaching said support to said housing frame.

18. Multi-exercising apparatus as defined in claim 1, wherein said housing frame has a pair of uprights each of which including a base provided with a throughhole, said support being a bench having a mounting element which traverses said throughhole to connect said bench to said housing frame.

19. Multi-exercising apparatus as defined in claim 1 wherein said housing frame is of box-shape.

20. Multi-exercising apparatus as defined in claim 19 wherein said housing frame is of trapezoid shape.

* * * * *